US006871577B2

(12) United States Patent
Warne et al.

(10) Patent No.: US 6,871,577 B2
(45) Date of Patent: Mar. 29, 2005

(54) FILL PUMP PISTON CENTERING SUPPORT

(75) Inventors: Wayne Warne, Burnsville, MN (US); Goran Hermodsson, Staffanstorp (SE); Ake Svedberg, Woodburg, MN (US); Yoshiki Katsumata, Buffalo Grove, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 58 days.

(21) Appl. No.: 10/356,140

(22) Filed: Jan. 31, 2003

(65) Prior Publication Data

US 2004/0149125 A1 Aug. 5, 2004

(51) Int. Cl.[7] ..... F01B 19/00
(52) U.S. Cl. ..... 92/97; 92/178
(58) Field of Search ..... 92/97, 99, 100, 92/178

(56) References Cited

U.S. PATENT DOCUMENTS 2,952,218 A * 9/1960 Steffes ..... 92/99
4,268,042 A * 5/1981 Borlan ..... 92/178
4,286,932 A * 9/1981 Nagano et al. ..... 92/97

* cited by examiner

*Primary Examiner*—F. Daniel Lopez
(74) *Attorney, Agent, or Firm*—Welsh & Katz, Ltd.

(57) ABSTRACT

A centering support for a piston in a piston-type pump having a diaphragm extending between the piston and the cylinder to define a product end of the pump and a driven end of the pump includes at least three equally radially spaced, centering elements extending radially outwardly from the piston for contacting the cylinder wall. The centering elements define a gap between the piston and the cylinder wall. The centering elements are disposed on the piston spaced from the diaphragm at the product end of the pump.

29 Claims, 2 Drawing Sheets

FILL PUMP PISTON CENTERING SUPPORT

BACKGROUND OF THE INVENTION

The present invention is directed to a support for a fill pump piston. More particularly, the present invention is directed to a support for a piston in a piston-type fill pump for use in a form, fill and seal packaging machine.

Form, fill and seal packaging machines are well known in the art. These machines are widely used in the food packaging industry for forming a package, filling the package with a liquid or solid food (or a mixture of liquid and solid foods), and sealing the package after filling. In many such machines, piston pumps are used to move or transport product (e.g., food product) from, for example, a storage tank to individual packages. Piston-type pumps provide for the requisite control over the flows and flow rates of the product.

In addition, in such machines, sterilization, generally, must be kept at a maximum. That is, all of the food or product contacting surfaces must be maintained at a high level of cleanliness in order to reduce the opportunity for product contamination. A number of processes and philosophies are carried out in such machines in order to maintain the requisite high levels of cleanliness. One such philosophy is to minimize the number of surfaces that contact the product, and particularly to reduce the number of moving surfaces, and close-moving mechanical surfaces that are product-contacting.

One primary example of this is in connection with the moving piston that is used to drive or transport the product. In one commonly used arrangement, a diaphragm is positioned between the piston and the cylinder wall to isolate the product from the close proximity piston and cylinder wall surfaces. In such an arrangement, the diaphragm, which is referred to as a rolling diaphragm, is positioned at the product end of the piston and extends to (and is sealed at) the cylinder wall. The diaphragm serves to substantially isolate the product from the space between the piston and cylinder wall where heat may be generated. The diaphragm also serves to isolate the product from the driver portion of the pump and other mechanical pump surfaces. Because the diaphragm is a flexible material, it "moves" with the pump and provides the necessary volumetric changes to allow moving or driving the product.

Although such an arrangement functions well to isolate the product from the moving mechanical components, because the diaphragm is positioned between the stationary cylinder wall and the moving piston, it is subject to wear by virtue of the rubbing of the surfaces. In addition, in the event that the piston is not aligned within the cylinder, there exists the potential for the diaphragm to rupture or otherwise fail prematurely (e.g., debraid, separate) as a result of the piston coming too close to the cylinder wall.

One way to overcome the potential for damaging the diaphragm by contact of the piston with the cylinder wall is to increase the gap between the piston and the cylinder by increasing the cylinder bore or decreasing the piston diameter. However, as the gap between the piston and cylinder wall increases, the volume of product moved (per pumping stroke) is subject to changes. This is problematic in that the volume of product pumped is a "measured" volume as such, the flow rate must be maintained at a precisely controlled rate. Moreover, as the gap increases, the overall support for the diaphragm decreases.

Accordingly, there exists a need for an improved alignment or centering system for a piston in a piston pump.

Desirably, such a centering system reduces the opportunity for the piston to contact the cylinder wall and as such reduces the wear on the pump diaphragm. Most desirably, such a centering system does not add any frictional or other force that could adversely effect the ability to accurately dose the amount of product transferred during the pump stroke, nor does it reduce significantly the amount of product transferred during each pump stroke.

BRIEF SUMMARY OF THE INVENTION

A form, fill and seal packaging machine includes a piston-type pump for moving a predetermined, measured amount of product into packages on the machine. The pump includes a diaphragm extending between the pump piston and the cylinder wall to define a product end of the pump and a driven end of the pump.

The centering support includes at least three equally radially spaced, centering elements extending outwardly from the piston for contacting the cylinder. In a present embodiment, six discrete centering elements are employed. The centering elements define a gap between the piston and the cylinder. The centering elements are disposed on the piston spaced from the diaphragm at the product end of the pump. The inserts can be individual or discrete elements positioned in the piston or alternately, they can be positioned on a carrier element, e.g., a carrier strip.

The present centering support improves alignment or centering of the piston. Such a centering system reduces the opportunity for the piston to contact the cylinder wall and as such reduces the wear on the pump diaphragm. Advantageously, such a centering system does not adversely effect the ability to accurately dose the amount of product transferred during the pump stroke, and, by permitting a reduced gap between the piston and cylinder it does not reduce significantly the amount of product transferred during each pump stroke.

In a preferred embodiment, the centering elements are formed from a low-friction material, preferably a polymeric material, such as polyvinylidene fluoride. The centering supports are formed as inserts that are set into recesses in the piston. The inserts are removable from the piston to facilitate replacement. To minimize contact with the cylinder wall, the centering elements are formed having a hemispherical shape.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
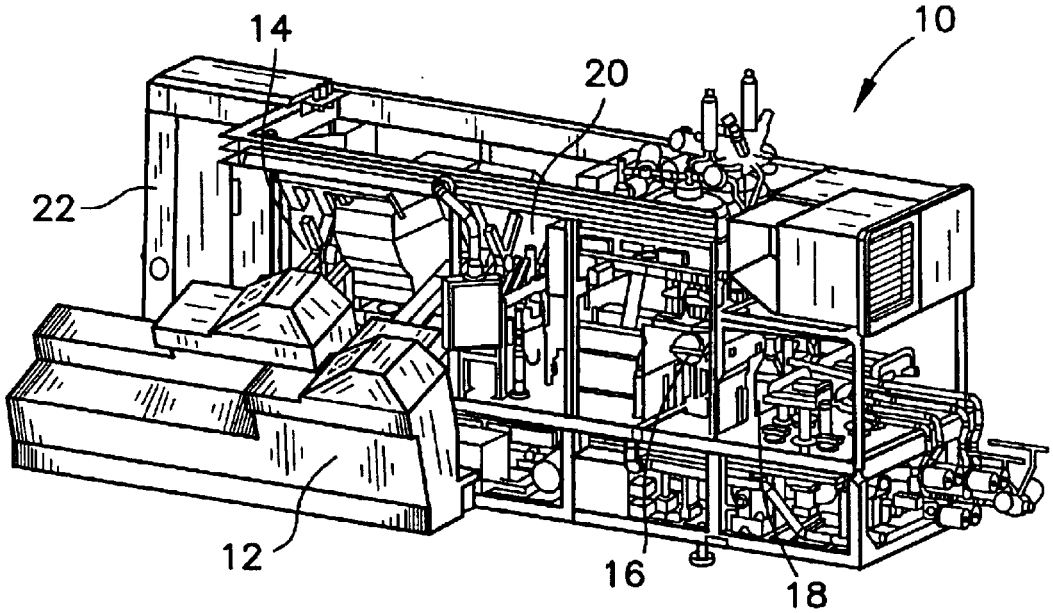
FIG. 1 illustrates an exemplary form, fill and seal packaging machine having an improved pump piston centering system embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a form, fill and seal packaging machine 10 that is configured to store a series of carton blanks in a flat, folded form, erect the blanks into a tubular form, fold and seal the bottom flaps of the carton, fill and seal the cartons as they move through the machine. The form, fill and seal packaging machine 10 can be such as that disclosed in Katsumata, U.S. Pat. No. 6,012,267, which patent is assigned to the assignee of the present invention and is incorporated herein by reference.

A typical filling machine includes a carton magazine 12 for storing the flat, folded carton blanks. The filling machine includes a carton erection station 14 that receives the cartons in the flat, folded form, and opens or erects the cartons into the tubular form. The tubular formed cartons are then bottom sealed. The cartons then traverse through a series of stations including a filling station 16 at which product P is filled into the carton, and a top sealing station 18 for sealing the top of the carton after filling. Other stations can include one or more sterilization stations 20 and a fitment or closure station (not shown) for positioning and securing a closure package (such as a spout and cap combination) to the carton. The overall operation of the machine 10 is controlled by a controller 22.

Figure 2:
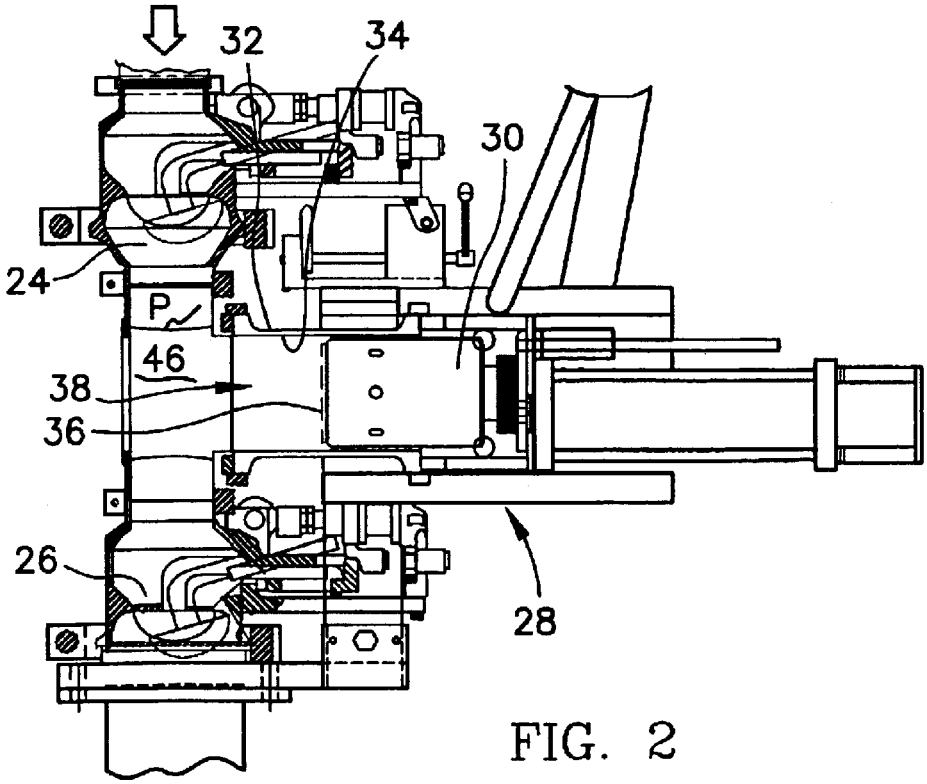
FIG. 2 is a plan view of an exemplary piston pump and valve arrangement used in the form, fill and seal machine of FIG. 1.
Figure 3:
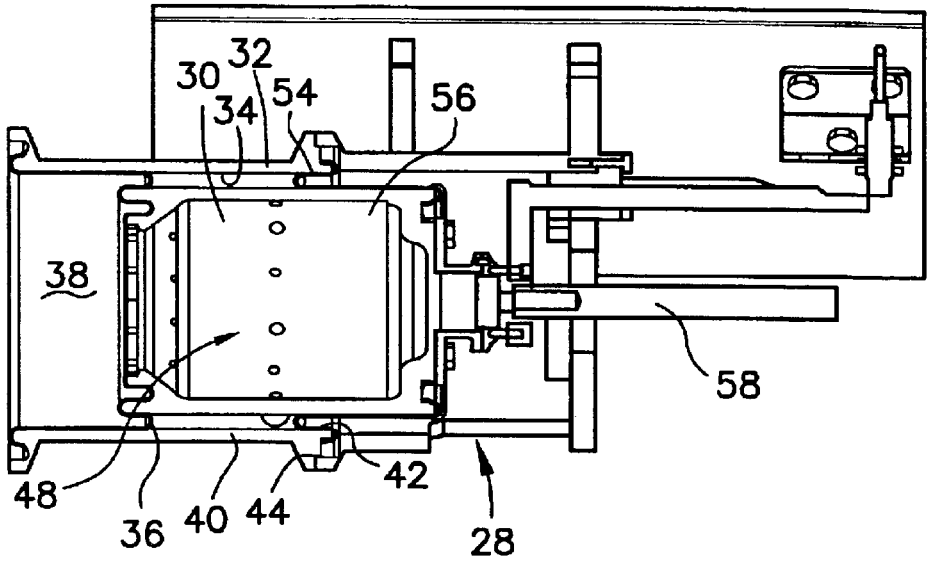
FIG. 3 is a cross-sectional view of the piston pump showing the present centering support.

Referring to FIGS. 2 and 3, the filling station includes one or more valves 24, 26 for initiating and terminating flow of product P to and from a piston-type pump 28. The pump 28 includes a piston 30 that reciprocates within a cylinder 32, defined by cylinder walls 34. As set forth above, because it is desired to minimize the number of surfaces that contact the product P (e.g., food), at least one diaphragm 36 extends across the product side 38 of the cylinder 32 to isolate the product P from the space 40 between the moving piston 30 and the stationary cylinder wall 34. The diaphragm 36 arrangement is of a rolling-type in which the diaphragm 36 rolls with the movement of the piston 30. In such an arrangement, the diaphragm 36 is mounted to the cylinder wall 34 (typically by a bead 42 secured within a mechanical joint 44) to define a peripheral seal about the wall 34. The piston 30 is located "behind" the diaphragm 36 and the product inlet and outlet (i.e., the product side 38) are located "in front" of the diaphragm 36. In this arrangement, the diaphragm 36 essentially isolates the piston 30 from the product P. The diaphragm 36 defines a product or pumping end or chamber 46.

As will be appreciated from the figures, the gap 40 between the cylinder wall 34 and the piston 30 is needed to accommodate the diaphragm 36. However, in order to minimize head loses and maintain the highest control of the amount of product P pumped, it is desired to maintain the gap 40 as small as possible. This is also desirable so as to support the diaphragm 36 to the greatest extent possible. Nevertheless, because of the nature of the moving piston 30, prior, known designs exhibited the potential for the piston 30 to move in an other than concentric manner (relative to the cylinder wall 34), that is, not fully linearly, and contact or "squeeze the diaphragm 36 between the piston 30 and the cylinder wall 34. This results in increased wear and possibly tearing of the diaphragm 36.

A present centering support system, indicated generally at 48, overcomes many of the problems encountered by off-center moving pistons. In a present support arrangement 48, a plurality of inserts 50 are positioned within recesses 52 formed in the piston 30. The inserts 50 are configured to contact the cylinder wall 34 and provide bearing sites or "points", indicated generally at 54, for the moving piston 30. The inserts 50 thus maintain the piston 30 spaced from the cylinder wall 34 and centered within the cylinder 32, without compromising control of the flow rate product P from the pump 28. As will be appreciated from a study of the figures, at least three such "points" 50 are required.

In a present support arrangement 48, the inserts 50 are formed having bearing portions 54 that are hemispherical in shape and extend outwardly from the cylindrical wall of the piston 30. That is, the insert bearing portions 54 have a generally half-sphere shape that is configured to contact and ride on the cylinder wall 34. It has been found that such a support provides the necessary centering of the piston 30, while at the same time, permitting a minimized gap 40 to maintain control over the product P flow rate. As will be appreciated from a study of the figures the inserts 50 are configured to remain in contact with the cylinder wall 34 so as to maintain the gap 40 between the piston 30 and the cylinder wall 34 and to prevent wobbling of the piston 30 as it reciprocates.

Figure 5:
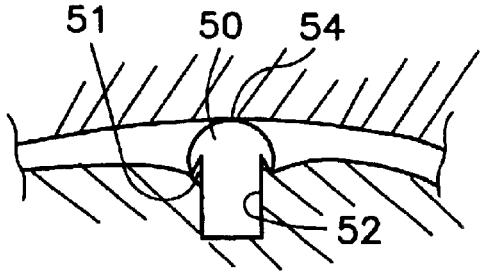
FIG. 5 is an enlarged, partial view of an insert set into the piston.
Figure 4:
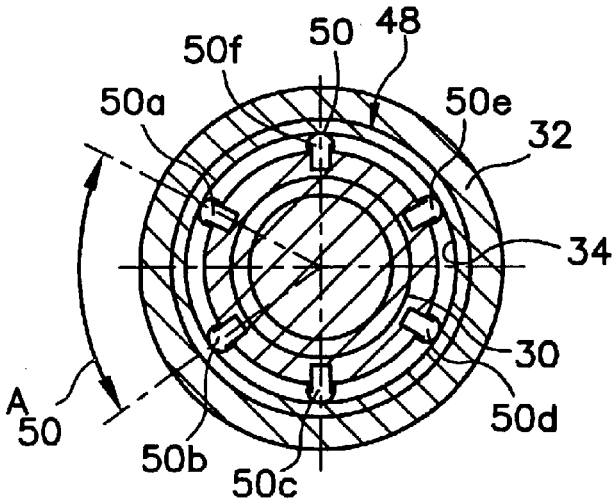
FIG. 4 is a partial cross-sectional view of the piston showing the position of the centering elements.

Referring briefly to FIG. 5, the inserts 50 are formed having undercut regions, indicated generally at 51 between the bearing portion 54 and the stem or body 55. The undercut regions 51 are formed to allow for dimensional changes in the piston 30, cylinder 32 and inserts 50, as may result from thermal changes. The undercut regions 51 also allow for tolerances in the machining and manufacture of the various pump 28 components.

The centering supports 50 are spaced about the periphery of the piston 30 such that the piston 30 is centered within the cylinder 32. In such an arrangement, the support elements 50 are positioned such that an are $A_{50}$ defined by any two adjacent elements, e.g., elements 50*a* and 50*b*, is less than 180 degrees. A present centering support arrangement 48 employs six such inserts 50*a*–50*f* that are equally radially spaced (at about 60 degrees) about the periphery of the piston 30. The inserts 50 can be formed from a low friction material, such as polyvinylidene fluoride (PVDF), or the like. A present insert 50 is readily replaceable within the piston 30 so that worn or damaged inserts 50 can be replaced as needed. Other insert 50 materials will be recognized by those skilled in the art and are within the scope and spirit of the present invention.

Figure 6:
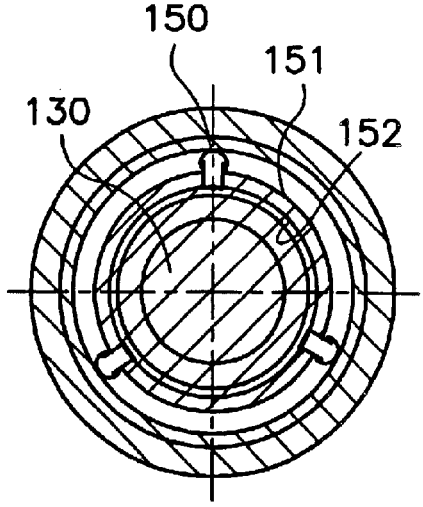
FIG. 6 is a partial cross-sectional view of an alternate pump piston centering support arrangement.

As seen in FIG. 6, the inserts 50 need not be individual elements; rather they can be formed as outwardly extending elements 150 formed on a ring or like carrier member 151. The carrier member 151 can be positioned in a recess in the 152 in the piston 130 such that the elements 151 extend beyond the periphery of the piston 130. Many such variations and other variations in the number, arrangement and mounting of the elements 50, 150 will be understood by those skilled in the art and are within the scope and spirit of the present invention.

A present pump arrangement 28 employs two diaphragms (an inner diaphragm 36 at the product end 38 of the piston 30 and an outer diaphragm 54 at the piston driven end 56), the inserts 50 are positioned within the recesses 52 in the piston 30 between the diaphragms 36, 54. In this manner, the inserts 50 are maintained isolated from the product P, which minimizes the potential to damage the inserts 50 (by maintaining the inserts 50 isolated from the product) and also furthers the design effort to minimize the number of product P contacting surfaces. The inserts 50 are also isolated from the driven side 56 to minimize wear and possible contamination from the pump driver 58 or driven side mechanical components.

This pump arrangement 28 defines the pumping chamber 46 between the inlet valve 24 and the outlet valve 26. The inlet and outlet valves 24, 26 are timed (to open and close) to assure that a predetermined, measured amount of product P is moved into the pump chamber 46, and, in conjunction with the pump 28 "size" assures the proper product P throughput during the pump 28 stroke. In such a design, an improved piston centering support system 48 is provided that does not in any way compromise the product P integrity, nor the "measured" amount of product P throughput.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A centering support for a piston disposed in a cylinder in a piston-type pump in a form, fill and seal packaging machine, the pump including a diaphragm extending between the piston and a cylinder wall to define a product end of the pump and a driven end of the pump, the centering support comprising:

at least three equally radially spaced, centering elements extending radially outwardly from the piston for contacting the cylinder wall, the centering elements being formed from a low-friction material and defining a gap between the piston and the cylinder wall, the centering elements disposed on the piston spaced from the diaphragm toward the driven end of the pump.

2. The centering support in accordance with claim 1 including six equally spaced, discrete centering elements.

3. The centering support in accordance with claim 1 wherein the centering elements are formed as discrete elements.

4. The centering support in accordance with claim 1 wherein the low-friction material is a polymeric material.

5. The centering support in accordance with claim 4 wherein the polymeric material is polyvinylidene fluoride.

6. The centering support in accordance with claim 1 wherein the centering elements are formed as inserts that are inset into recesses in the piston.

7. The centering support in accordance with claim 6 wherein the inserts are removable from the piston.

8. A centering support for a piston disposed in a cylinder in a piston-type pump in a form, fill and seal packaging machine, the pump including a diaphragm extending between the piston and a cylinder wall to define a product end of the pump and a driven end of the pump, the centering support comprising:

at least three equally radially spaced, centering elements extending radially outwardly from the piston for contacting the cylinder wall, the centering elements defining a gap between the piston and the cylinder wall, the centering elements disposed on the piston spaced from the diaphragm toward the driven end of the pump, wherein the centering elements are formed having a hemispherical shape.

9. The centering support in accordance with claim 8 wherein the centering elements are formed having a bearing portion for contacting the cylinder wall and an undercut region at about a juncture of the insert with the piston.

10. A piston pump of the type having an inlet, and outlet and a pumping chamber between the inlet and the outlet, comprising:

a cylinder;

a piston disposed for reciprocating movement in the cylinder;

a diaphragm extending from the piston to the cylinder, the diaphragm forming a seal and defining a driving end of the pump opposite the pumping chamber;

a driver operably connected to the piston at the driving end of the pump, the driver providing reciprocating movement of the piston; and at least three centering elements disposed on the piston, the centering elements being formed from a low-friction material, the centering elements being disposed such that an arc formed between any two adjacent centering elements is less than 180 degrees.

11. The piston pump in accordance with claim 10 including six centering elements, each centering element equally spaced from its adjacent centering elements.

12. The piston pump in accordance with claim 10 wherein the centering elements are disposed on the piston at the driving end of the pump.

13. The piston pump in accordance with claim 12 including a second diaphragm disposed between the centering supports and the driver.

14. The piston pump in accordance with claim 13 wherein each centering element is circumferentially equally spaced from each adjacent centering element.

15. The piston pump in accordance with claim 10 wherein the centering elements are formed as inserts that are inset into recesses in the piston.

16. The piston pump in accordance with claim 15 wherein the inserts are removable from the piston.

17. The piston pump in accordance with claim 10 wherein the low-friction material is a polymeric material.

18. The piston pump in accordance with claim 17 wherein the polymeric material is polyvinylidene fluoride.

19. The piston pump in accordance with claim 10 wherein the centering elements are formed as discrete elements.

20. A piston pump of the type having an inlet, and outlet and a pumping chamber between the inlet and the outlet, comprising:

a cylinder;

a piston disposed for reciprocating movement in the cylinder;

a diaphragm extending from the piston to the cylinder, the diaphragm forming a seal and defining a driving end of the pump opposite the pumping chamber;

a driver operably connected to the piston at the driving end of the pump, the driver providing reciprocating movement of the piston; and at least three centering elements disposed on the piston, the centering elements being disposed such that an arc formed between any two adjacent centering elements is less than 180 degrees, wherein the centering elements are formed having a hemispherical shape.

21. The piston pump in accordance with claim 20 wherein the centering elements are formed having a bearing portion for contacting the cylinder wall and an undercut region at about a juncture of the insert with the piston.

22. In a form, fill and seal packaging machine of the type having a product supply and a filling section having a piston pump having an inlet for receiving product from the product supply and an outlet for moving a predetermined, measured amount of product from the out of the outlet, the piston pump comprising:

a cylinder disposed between the inlet and the outlet;

a piston disposed for reciprocating movement in the cylinder;

a diaphragm extending from the piston to the cylinder, the diaphragm forming a seal and defining a driving end of the pump opposite the pumping chamber;

a driver operably connected to the piston at the driving end of the pump, the driver providing reciprocating movement of the piston; and at least three discrete centering elements disposed on the piston, the centering elements being disposed such that an arc formed between any two adjacent centering elements is less than 180 degrees.

wherein the centering elements are formed having a hemispherical shape.

23. The form, fill and seal packaging machine in accordance with claim 22 wherein the centering elements are formed having a bearing portion for contacting the cylinder wall and an undercut region at about a juncture of the insert with the piston.

24. In a form, fill and seal packaging machine of the type having a product supply and a filling section having a piston pump having an inlet for receiving product from the product supply and an outlet for moving a predetermined, measured amount of product from the out of the outlet, the piston pump comprising:

a cylinder disposed between the inlet and the outlet;

a piston disposed for reciprocating movement in the cylinder;

a diaphragm extending from the piston to the cylinder, the diaphragm forming a seal and defining a driving end of the pump opposite the pumping chamber;

a driver operably connected to the piston at the driving end of the pump, the driver providing reciprocating movement of the piston; and at least three discrete centering elements disposed on the piston, the centering elements being formed from a low-friction material and being disposed such that an arc formed between any two adjacent centering elements is less than 180 degrees.

25. The form, fill and seal packaging machine in accordance with claim 24 wherein the inlet and outlet are generally aligned with one another and wherein the piston pump is disposed such that the piston reciprocates generally transverse to the alignment of the inlet and the outlet.

26. The form, fill and seal packaging machine in accordance with claim 24 including six equally circumferentially spaced centering elements.

27. The form, fill and seal packaging machine in accordance with claim 24 including a second diaphragm disposed between the centering supports and the driver.

28. The form, fill and seal packaging machine in accordance with claim 24 wherein the centering elements are formed as discrete elements.

29. The form, fill and seal packaging machine in accordance with claim 24 wherein the centering elements are formed as replaceable inserts that are set into recesses in the piston.

* * * * *